United States Patent [19]

Kunze et al.

[11] Patent Number: 4,483,789

[45] Date of Patent: Nov. 20, 1984

[54] METHOD FOR PERMANENTLY STORING RADIOACTIVE ION EXCHANGER RESINS

[75] Inventors: Siegmar Kunze, Gernsbach; Gerhard Eden, Eggenstein; Rainer Köster, Karlsruhe, all of Fed. Rep. of Germany

[73] Assignee: Kernforschungszentrum Karlsruhe GmbH, Fed. Rep. of Germany

[21] Appl. No.: 513,953

[22] Filed: Jul. 15, 1983

[30] Foreign Application Priority Data

Nov. 8, 1979 [DE] Fed. Rep. of Germany ..... 2945007

[51] Int. Cl.[3] ..... G21F 9/16

[52] U.S. Cl. ..... 252/628; 252/630

[58] Field of Search ..... 252/628, 633

[56] References Cited

FOREIGN PATENT DOCUMENTS 2717656 10/1978 Fed. Rep. of Germany ..... 252/628

OTHER PUBLICATIONS

Lerch et al. "Treatment and Immobilization of Intermediate Level Radioactive Wastes" in Carter et al., eds. *Managment of Low-Level Radioactive Waste,* vol. 1, 1979, pp. 513, 540–543.

Rudolph et al. "Immobilization of Strontium . . ." in McCarthy et al., eds., Scientific Basis for Nuclear Waste Mgmt. vol. 1, 1979, pp. 467–470.

*Primary Examiner*—Brooks H. Hunt

*Attorney, Agent, or Firm*—Sughrue, Mion, Zinn, Macpeak, and Seas

[57] ABSTRACT

A method for forming a hardened product containing a radioactive ion exchanger resin in a condition for permanent, noncontaminating storage, by the steps of:

providing, before fixing, a mass of such ion exchanger resin saturated in water, the resin being at least one resin selected from the group consisting of spherical resins and powdered resins;

mixing the resin mass, with stirring, with a blast furnace cement having a composition which causes it to exhibit slow initial hardening, high sulfate resistance and low hydration heat and with a quantity of additional water equal in weight to 20% to 40% of the weight of the blast furnace cement; and allowing the resulting mixture to harden at room temperature.

14 Claims, No Drawings

METHOD FOR PERMANENTLY STORING RADIOACTIVE ION EXCHANGER RESINS

This application is a continuation of application Ser. No. 203,678, filed Nov. 3, 1980.

BACKGROUND OF THE INVENTION

The present invention relates to a method for the solidification of radioactive ion exchanger resins for permanent, noncontaminating storage, wherein the ion exchanger resin in powdered and/or spherical form is well mixed by stirring with a cement and water and is then left to stand at room temperature for hardening.

In nuclear energy plants, organic ion exchangers or ion exchanger resins, are used to clean coolant waters or to treat aqueous solutions. These ion exchanger resins absorb radioactive contaminants while they are in use until their capacity has been exhausted. Since the radioactive substances in such spent and no longer usable ion exchanger resins are not firmly bound, the resins must be embedded in a leaching resistant matrix and solidified before they are put into permanent storage. It has been known for a long time to mix water which contains ion exchanger resins with cement which then hardens while absorbing water and encases the ion exchanger resins. The products obtained in this way, which consist of cement blocks with incorporated resin, have relatively poor properties. It has been noted, for example, that after a relatively short time of storage, such cement blocks exhibit cracks and may break up, sometimes even into smaller pieces. Light impacts accelerate or augment the release of breaking out of parts of the solidified product. The chemical stability of such products is also relatively slight. Generally such ion exchanger cement block products break up after only a few days if they are stored in water at room temperature. This means that the effective surface area susceptible to leaching is immensely enlarged by this decaying process and retention of the radioactive substances in the solified block is no longer assured in every case.

It has been proposed to permanently avoid such unacceptable changes in the properties of ion exchanger cement blocks by adding to the ion exchanger-water-cement mixture before hardening a substance which has the capability of preventing the penetration of water to the grains of the ion exchanger resin in the solidified block, as disclosed in German Offenlegungsschrift [laid-open application] No. 2,549,195. Substances which have been suggested to be suitable for this purpose include polymer material, such as polyvinyl propionate, or another linear polymer, such as, for example, polyvinyl acetate or polyvinyl butyrate, or an epoxy resin or another polymer having the capability of undergoing cross-linking reactions, such as, for example, a phenol formaldehyde resin, or a silicone; such substances may also be an alkali silicate, such as waterglass, an organic hydrolizable silicate, such as tetraethyl silicate, as well as a monomeric organic ester of higher fatty acids, such as, for example, an ester of palmitic acid or stearic acid with glycol or glycerine.

It has been proposed to add to the still liquid mixture 0.1 to 20 parts by weight, per 100 parts by weight of cement, of a substance which blocks the penetration of water. In this way, it has been disclosed 26 parts by weight dry ion exchanger resin, i.e. not quite 14 percent by weight, can be solidified. However, this method is not only complicated but also very expensive. In the solidification of radioactive substances, as well as in their transport and removal or permanent storage, respectively, the cost factor plays an important part. Improvements of the properties of the solidified product of ion exchange resins, water and cement, such as, for example, sufficient compressive strength of the hardened product (of the order of magnitude of 10 N/mm$^2$) and thus also long-term stability, high leaching resistance and great capability to absorb ion exchanger resin, i.e. a larger amount of resin in the final product, are in competition with processability and cost factors.

SUMMARY OF THE INVENTION

It is an object of the present invention to provide a method for solidifying radioactive ion exchanger resins in cement blocks for permanent, noncontaminating storage wherein the drawbacks of the prior art methods are avoided.

A more specific object of the invention is to produce solidified products having a stability which is maintained for long periods of time, as required for the permanent storage of radioactive wastes, particularly having a pressure resistance of at least 10 Newton/mm$^2$, as well as a high resistance to leaching.

Another specific object of the invention is to assure inclusion of a large proportion of ion exchanger resins, spherical resins as well as powdered resins, in the end product without further complicated process steps or without the need for additional stabilizing means.

The above and other objects are achieved, according to the invention, by a method for forming a hardened product containing a radioactive ion exchanger resin in a condition for permanent, noncontaminating storage, which includes the steps of:

providing, before fixing, a mass of such ion exchanger resin saturated in water, the resin being at least one resin selected from the group consisting of spherical resins and powdered resins;

mixing the resin mass, with stirring, with a blast furnace cement having a composition which causes it to exhibit slow initial hardening, high sulfate resistance and low hydration heat and with a quantity of additional water equal in weight to 20% to 40% of the weight of the blast furnace cement; and allowing the resulting mixture to harden at room temperature.

According to preferred embodiments of the invention, the quantity of resin employed corresponds to a dry resin weight equal to 10% to 25% in the case of spherical resin particles and 6% to 15% in the case of powdered resin, of the total weight of the hardened product.

The invention is based on applicants' discovery that selection of a blast furnace cement (BFC) having the abovedescribed properties from a plurality of cement types, in combination with the above-stated relatively narrowly defined process conditions provides a solution to the problems in question.

Advantageously, in the case of spherical resins, between 10 weight percent and 25 weight percent of ion exchanger resin and, in the case of powdered resins, between 6 weight percent and 15 weight percent of ion exchanger resin, both with reference to the hardened end product and to the dry weight of the resin, are mixed in water saturated form with the mixing water and/or with the blast furnace cement.

The desired blast furnace cement is obtained by finely comminuting, jointly, 15 to 69 parts by weight of Portland cement clinker and, correspondingly, 85 to 31 parts by weight of rapidly cooled blast furnace slag. The blast furnace cement should contain less than 55 weight percent calcium oxide. The content of sulfuric acid anhydride ($SO_3$) must not exceed 4 weight percent with respect to the heat treated cement. Further components in the chemical composition of the blast furnace cement (BFC) are: $SiO_2$=22 to 29 weight percent; $Al_2O_3+TiO_2$=6 to 13 weight percent; $Fe_2O_3(FeO)$=1 to 3 weight percent; MgO=1 to 5 weight percent; and $Mn_2O_3(MnO)$=0.2 to 1.5 weight percent.

By saturating the resins with water or radioactive waste water it is possible to avoid later swelling in the already hardened block which would result in bursting or breaking apart of the block. By properly selecting the blast furnace cement, the proportion of ion exchanger resins in the end product can be increased up to 25 percent by weight without diminishing the sum of the properties of the solidified product. Finally, the given narrow range for the ratio of water to cement assures the good properties of the block ready for permanent storage even if there is a large proportion of resin in the end product. The method according to the present invention can be used not only to solidify spherical resins, but also for powdered resins or mixtures of spherical and powdered resins. The present invention will now be explained with the aid of a few examples. One comparison example with Portland cement (PC 35 F) is presented to better bring out the improved properties of the end products produced according to the method of the invention.

EXAMPLE 1

An ion exchanger resin loaded with cesium$^{137}$ was saturated with water and mixed with BFC-35 L/HS-NW and water. The terms employed to identify this BFC have the following significance: 35 designates the compressive strength which is 35 N/mm$^2$; L designates slow initial hardening; HS designates high sulfate resistance; and NW designates low hydration heat. The component proportions were selected to provide the following weight percentages in the end product: BFC 62.9; ion exchanger resin (with respect to its dry weight) 8.7; and total water content (mixing water+water to saturate the resin) 28.4. The mixture was stored for 28 days in a closed container at room temperature and then subjected to leaching in distilled water for another 50 days after which it was examined. The block, which had a water-cement ratio, with respect only to the mixing water, of 0.31, hardened after 6½ to 7 hours and after 78 days exhibited a compressive strength of 28.0 N/mm$^2$. The relative diffusion constant of cesium$^{137}$ was $2.8\times10^{-6}$ cm$^2\times$d$^{-1}$ (ISO test but without changing the distilled water). A spherical resin was used as the ion exchanger resin. Water saturated spherical resins contain about 50 weight percent water which, as regards calculation, is included in the term for total water content.

EXAMPLE 2

Spherical resin charged with cesium$^{137}$, corresponding to 20.5 weight percent dry resin in the end product, was mixed with an aqueous suspension of BFC-35L/HS-NW, corresponding to 44.6 weight percent BFC and 34.9 weight percent total amount of water in the end product, and the mixture was permitted to harden. The water-cement ratio, with respect merely to the mixing water, in this case was 0.32, which corresponds to a water-cement ratio of 0.78 with respect to the total water content. The block hardened after 10 hours and after a total of 78 days, which were divided up according to the same scheme as in Example 1, it exhibited a compressive strength of 19.3 N/mm$^2$. The relative diffusion constant of cesium$^{137}$ in this case was $1.4\times10^{-5}$ cm$^2\times$d$^{-1}$.

EXAMPLE 3

Water saturated spherical resin containing cesium$^{137}$ corresponding to 26.6 weight percent in the end product was mixed with an aqueous suspension of BFC-35L/HS-NW, corresponding to 38.6 weight percent BFC and 34.8 weight percent total water content in the end product, and the mixture was permitted to harden. The water-cement ratio, with respect to only the mixing water, was 0.21 which corresponded to a water-cement ratio of 0.90 with respect to the total water content. After a total of 78 days, which are divided according to the same scheme as in Example 1, the compressive strength was 13.5 N/mm$^2$. The relative diffusion constant of cesium$^{137}$ was $6.4\times10^{-5}$ cm$^2\times$d$^{-1}$. This block also exhibits good properties although the leaching resistance is somewhat lower than that of the blocks of Examples 1 and 2.

EXAMPLE 4

Water saturated powdered resin corresponding to 9.0 weight percent with respect to the dry weight of the resin, was mixed with an aqueous suspension of BFC-35L/HS-NW, corresponding to 55.6 weight percent BFC and 35.4 weight percent total water content in the end product, and the mixture was permitted to harden. The water saturated powdered resin contains 70 percent by weight water and 30 percent by weight resin. The water-cement ratio, with reference only to the mixing water, was 0.26, which corresponded to a water-cement ratio of 0.64 with respect to the total water content. The block hardened after 4 hours and after a total of 78 days (28 days storage in a closed container at room temperature and 50 days storage in distilled water) it exhibited a compressive strength of 12.6 N/mm$^2$. No cesium leaching rates were examined in this case.

EXAMPLE 5

Water saturated powdered resin, corresponding to 13.0 weight percent in the end product with respect to the dry weight of the resin, was mixed with water and BFC-35L/HS-NW corresponding to 47.1 weight percent BFC and 39.9 weight percent total water in the end product, and the mixture was permitted to harden. The water-cement ratio, with respect to the mixing water alone, was 0.20, which corresponds to a water-cement ratio of 0.85 with respect to the total water content. The hardening time for the block was 5 hours. After a total of 78 days, which were divided as in Example 4, a compressive strength of 14.0 N/mm$^2$ was measured. In this case as well, leaching was not examined.

Comparison Examples with Portland Cement

COMPARISON EXAMPLE A

Water saturated spherical resin containing cesium$^{137}$ corresponding to 9.0 weight percent in the end product with respect to the dry weight, was stirred in an aqueous suspension of PC 35F, corresponding to 65.2 weight percent PC and 25.8 weight percent total water content in the end product and permitted to harden.

The hardening period was 8 to 9 hours. The water-cement ratio with respect to the mixing water alone was determined to be 0.26, which corresponds to a water-cement ratio of 0.40 with respect to the total water content. Due to the small proportion of ion exchanger resins in the end product and due to the very low water-cement ratio with respect to the total water content, the compressive strength after 78 days, divided as in Example 1, was still relatively high at 27.6 $N/mm^2$, the relative diffusion constant of cesium$^{137}$, however, was higher by one power of ten compared to the product of Example 1, i.e. it was $2.1\times10-5\ cm^2\times d^{-1}$, and thus worse.

COMPARISON EXAMPLE B

Water saturated spherical resin, corresponding to 15.6 weight percent in the end product with respect to the dry weight of the resin, was stirred in an aqueous suspension of PC 35 F, corresponding to 54.1 weight percent PC and 30.3 weight percent total water content in the end product, and the mixture was permitted to harden. The hardening time in this case was 10 to 13 hours. The water-cement ratio with respect to the mixing water alone was 0.27, which corresponds to a water-cement ratio of 0.56 with respect to the total water content. This block fell apart in a short period of time after being immersed in distilled water. Determination of the relative diffusion constant of cesium$^{137}$ thus was no longer appropriate. A comparison of this block with the blocks of Examples 2 and 3, which had a much greater proportion of ion exchanger resin in their end product, shows the superiority of the process according to the invention.

The German Industrial Standard No. 1164, Part 1, (Nov. 1978) defines as follows the constituents of blast furnace cement (BFC):

Portland cement clinker mainly consists of calcium silicates. It is fabricated by burning at least up to sintering a precisely specified, finely distributed homogeneous mixture of raw materials (raw meal or raw slurry) containing above all calcium oxide CaO and silica $SiO_2$ and to a lesser extent aluminium oxide $Al_2O_3$, iron oxide $Fe_2O_3$ and other oxides.

Blast furnace slag is obtained by quick cooling from the molten blast furnace slag produced in the metallurgical treatment of iron containing lime, alumina and silicate. Its composition in percent by weight must obey the following formula:

$$(CaO+MgO+Al_2O_3)/SiO_2 \geqq (1)$$

Portland cements (PC) and blast furnace cements (BFC) differ in their curing behavior. The designation 35 F for Portland cement means that, on the one hand, a compressive strength after 28 days of at least 35 $N/mm^2$ and of 55 $N/mm^2$ at the maximum must be attained and, on the other hand, a compressive strength of at least 10 $N/mm^2$ after two days (F). The designation 35 L/HS-NW for BFC means that the cement after 28 days must exhibit a compressive strength of at least 35 $N/mm^2$ with slow initial hardening (L), a solidification time of about five hours, a high sulfate resistance (HS) (this is ensured for BFC with at least 70 wt. % of blast furnace slag and a maximum of 30 wt. % of Portland cement clinker) as well as a low hydration heat (NW): During the first seven days of hardening the heat developed by the cement must not exceed 270 J per g of cement.

The grains of the spherical resins used in the examples were of the order of 0.3 mm to 1.25 mm while the grains of the powdered resins used were smaller than 150 micrometers. For example, a highly acid gel-type cationic exchanger (supplied by Bayer AG, Leverkusen; trademark: Lewatit S 100 KR/H; matrix: polystyrene; ion exchanging group: sulfonic acid) was used as a spherical resin and a highly basic powdered anionic exchanger (supplied by Bayer AG, Leverkusen; trademark: Lewasorb A 50; matrix: polystyrene; ion exchanging group: quarternary amine) was solidified as a powdered resin.

In case of solidification of mixtures consisting of spherical resins and powdered resins the maximum percent by weight of resin mixture used, related to the hardened end product and dry weight of the resins, corresponds to the ratio of spherical resins of powdered resins, assuming 25 wt. % for 100% spherical resins and 15 wt. % for 100% powdered resin. This means that the value attains 22.5 wt. % for a mixture consisting of 75% spherical resins and 25% powdered resins and 17.5 wt. % for a mixture consisting of 25% spherical resins and 75% powdered resins.

The minimum amounts (in wt. %) for both spherical resins and powdered resins still to be solidified depend on practical and economic aspects, respectively. If inactive water is used for mixing, this limit lies at approximately 3 wt. %. If, however, radioactive waste water is used for mixing, this limit may be at about 1 wt. %.

The wording "providing, before mixing, a mass of such ion exchanger resin saturated in water" means that if a dry mass of resin is used as the starting material, it must be saturated in water while in the presence of a resin slurry rich in water this slurry is separated from the water in excess so that in each case a water saturated resin is obtained. Only in this way the method according to the invention and the subsequent process steps, respectively, can be performed under constant conditions.

It is to be understood that the above description of the present invention is susceptible to various modifications, changes and adaptations, and the same are intended to be comprehended within the meaning and range of equivalents of the appended claims.

What is claimed is:

1. A method for forming a hardened product containing a radioactive ion exchanger resin in a condition for permanent, noncontaminating storage, comprising:

providing, before fixing, a mass of such ion exchanger resin saturated in water, the resin being at least one resin selected from the group consisting of spherical resins and powdered resins;

mixing the resin mass, with stirring, with a blast furnace cement having a composition which causes it to exhibit slow initial hardening, high sulfate resistance and low hydration heat and with a quantity of additional water equal in weight to 20% to 40% of the weight of the blast furnace cement; and allowing the resulting mixture to harden at room temperature.

2. A method as defined in claim 1 wherein the water in which the resin is saturated is composed of weakly to medium radioactive waste water.

3. A method as defined in claim 1 wherein the additional water is composed of weakly to medium radioactive waste water.

4. A method as defined in claim 1 wherein the resin consists of spherical resin in a quantity corresponding to a dry resin content of up to 25% by weight, in the hardened product.

5. A method as defined in claim 4 the quantity of resin corresponds to a dry resin content of at least 10%, by weight, in the hardened product.

6. A method as defined in claim 1 wherein the resin consists of powdered resin in a quantity corresponding to a dry resin content of up to 15%, by weight, in the hardened product.

7. A method as defined in claim 6 wherein the quantity of resin corresponds to a dry resin content of at least 6%, by weight, in the hardened product.

8. A method as defined in claim 1 wherein the blast furnace cement provides the only substances stabilizing the resin during hardening of the mixture.

9. The method as defined in claim 1, wherein the blast furnace cement comprises 15 to 69 parts by weight of Portland cement clinker and correspondingly, 85 to 31 parts by weight of rapidly cooled blast furnace slag.

10. The method as defined in claim 9, wherein the blast furnace cement contains less than 55 weight percent calcium oxide, $SiO_2$ in an amount of 22 to 29 weight percent; $Al_2O_3+TiO_2$ in an amount of 6 to 13 weight percent; $Fe_2O_3$ (FeO) in an amount of 1 to 3 weight percent; MgO in an amount of 1 to 5 weight percent; and $Mn_2O_3$ (MnO) in an amount of 0.2 to 1.5 weight percent.

11. The method as defined in claim 9, wherein the blast furnace cement has the designation 35 L/HS-NW.

12. A method as defined in claim 2 wherein the additional water is composed of weakly to medium radioactive waste water.

13. A method as defined in claim 1, wherein the resin is a spherical resin in a quantity corresponding to a dry resin content of 8.7 to 26.6%.

14. A method as defined in claim 13, wherein the resin is in a quantity corresponding to a dry resin content of 8.7% by weight, in the hardened product.

* * * * *